US005478404A

United States Patent [19]

Kennamer

[11] Patent Number: 5,478,404

[45] Date of Patent: Dec. 26, 1995

[54] METHOD FOR CLEANING THE BLADE OF A FOOD PRODUCT SLICING MACHINE

[75] Inventor: Jack J. Kennamer, Maineville, Ohio

[73] Assignee: KatchAll Industries International, Inc., Cincinnati, Ohio

[21] Appl. No.: 340,705

[22] Filed: Nov. 16, 1994

Related U.S. Application Data

[62] Division of Ser. No. 126,372, Sep. 24, 1993.

[51] Int. Cl.[6] ..... B08B 1/04; B08B 7/04

[52] U.S. Cl. ..... 134/6; 134/25.2; 134/25.3; 134/33

[58] Field of Search ..... 134/6, 9, 15, 25.2, 134/25.3, 25.5, 32, 33; 29/DIG. 7, DIG. 97, DIG. 98; 252/91, 174; 15/104.93

[56] References Cited

U.S. PATENT DOCUMENTS

| | | | |
|---|---|---|---|
| 977,680 | 12/1910 | Robison . | |
| 1,599,054 | 9/1926 | Lehr | 15/244.4 |
| 3,283,357 | 11/1966 | Decker et al. | 15/506 |
| 3,529,309 | 9/1970 | Leavitt et al. . | |
| 3,707,012 | 12/1972 | Lane | 15/104.93 |
| 4,011,693 | 3/1977 | Eldridge, Jr. et al. . | |
| 4,506,404 | 3/1985 | Clay . | |
| 4,596,668 | 6/1986 | Berbeco | 252/500 |
| 4,606,850 | 8/1986 | Malik | 252/528 |
| 4,666,671 | 5/1987 | Purzycki et al. . | |
| 4,752,983 | 6/1988 | Grieshaber | 15/218.1 |
| 5,016,401 | 5/1991 | Mangus | 15/218.1 |
| 5,024,704 | 6/1991 | Prouty | 134/6 |

*Primary Examiner*—Jan H. Silbaugh
*Assistant Examiner*—Robin S. Gray
*Attorney, Agent, or Firm*—Wood, Herron & Evans

[57] ABSTRACT

A sanitizing block for cleaning the blade of a food product slicer is manufactured from an inert material, such as cellulose sponge, which does not crumble nor dull the blade of the slicer when positioned on the carriage and sliced in the normal manner as would be used for a chunk of meat or cheese. The sanitizing block is preferably pre-moistened with a sanitizing solution to aid in the cleaning of the slicer and blade. The sanitizing block is useful as a compliment to the normal cleaning procedures of the slicer which often require disassembly of the slicer and washing of the component parts. The sanitizing block reduces food-born bacteria and minimizes carryover flavors from previously sliced items by removing residue remaining on the blade and slicer.

7 Claims, 1 Drawing Sheet

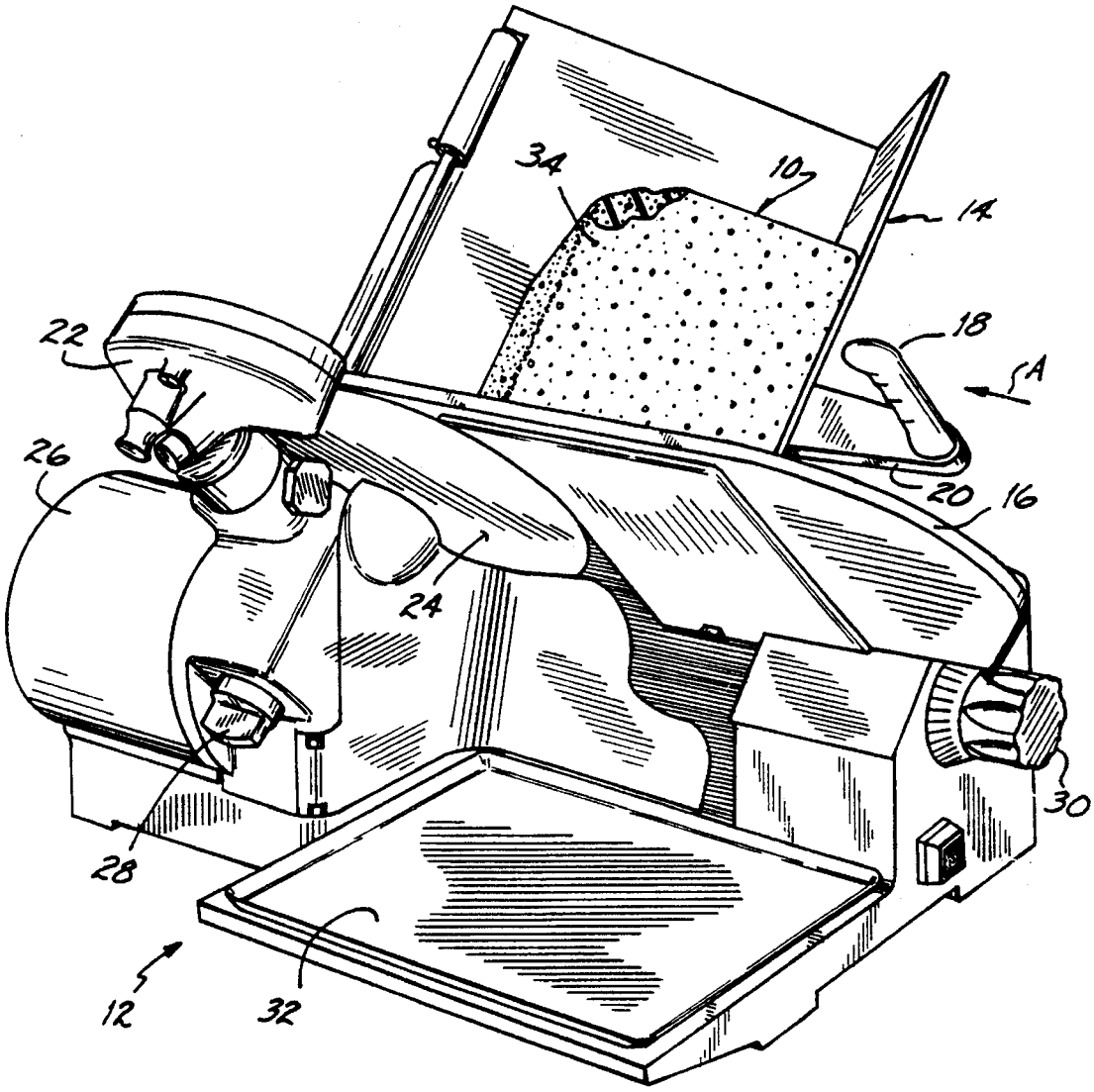
34
10
14
18
A
22
26
20
16
24
30
28
12
32

METHOD FOR CLEANING THE BLADE OF A FOOD PRODUCT SLICING MACHINE

This is a division of application Ser. No. 08/126,372, filed Sep. 24, 1993.

BACKGROUND OF THE INVENTION

This invention relates generally to a method and an apparatus for cleaning cutting blades. More particularly, the invention relates to a method and apparatus for cleaning the blade of a food product slicing machine.

Food product slicing machines are widely used in butcher shops and meat departments of grocery stores and typically are used for slicing large blocks of meats and cheeses. In one common embodiment, the food slicing machine typically includes a produce carriage for supporting the block of meat, cheese or other produce to be sliced. The carriage is mounted on the slicing machine for back and forth oscillatory movement along a generally linear path and is often angled so that the item to be sliced is carried on an inclined plane. The item to be sliced slides by gravity or is carried toward a circular rotating blade. The rotating blade is offset with respect to a transverse end wall bordering the carriage so that as the carriage oscillates back and forth across the blade, the block of meat or cheese to be sliced is maintained in contact with end wall and a section thereof is sliced by the rotating blade. The portion of meat or cheese sliced from the block falls onto a tray positioned below the blade and carriage of the slicing machine. Where the sliced portion falls by gravity, slicing machines of the type described are often called "gravity slicers".

Typically, food product slicing machines are required by applicable laws and by good practice to be cleaned and disinfected at least daily. The slicing machines and especially the blade must be adequately cleaned to remove food-born bacteria and other disease carrying contaminants. The cleaning procedure often includes disassembly of the slicing machine and washing of the individual component parts. Problems associated with the cleaning of slicing machines through the complete disassembly thereof include the very time consuming and labor intensive procedure associated with the disassembly procedure. Furthermore, the disassembly and reassembly of the product slicing machine is often difficult and potentially dangerous for the worker in that the circular blade is very sharp.

Slicing machines of the type described are often used for the slicing of meats, poultry, cheeses, and vegetables. It is a common practice to slice these different items on the same slicing machine without completely disassembling and cleaning the slicing machine as previously described. Therefore, a common problem is the carryover of flavors from the previously sliced items to subsequently sliced items. Residual amounts of each item sliced on the slicing machine typically remain on the blade, the carriage and the end wall of the slicing machine and thereby contaminate subsequent items.

SUMMARY OF THE INVENTION

It has been an objective of this invention to provide an improved, simplified and faster method and apparatus for the safe and convenient cleaning of food product slicing machines.

A further objective of this invention has been to provide a method and apparatus for the cleaning of food product slicing machines to be used in conjunction with the disassembly and washing of the individual slicing machine components.

A further objective of this invention has been to provide a method and apparatus for the prevention of carryover flavors by reducing the amount of residue remaining on the slicing machine from previously sliced items.

These objectives of this invention are attained by the provision of a sanitizing block or slab of a blade cleaning composition which can be easily cut by the blade of the food product slicing machine. The block is preferably made of an inert material which when positioned on the carriage of the slicing machine like a block of meat or cheese, can be cut by the slicing machine blade. The sanitizing block consists of a material which, when sliced by the blade, wipes, abrades, and/or cleans the blade yet does not crumble nor leave particles, other than a sectioned or sliced portion of the block which may fall onto the tray of the slicing machine. Likewise, the material of a sanitizing block of this invention does not dull nor damage the circular blade and thereby maintains a sharp edge for slicing. The sanitizing block is preferably manufactured of an inert cellulose sponge, sea sponge, or poly foam material having cuttable and non-crumble characteristics.

The sanitizing block is preferably absorbent and packaged premoistened with a direct food contact, no-rinse sanitizing chemical or cleansing solution which will sanitize the product slicing machine blade and carriage when sliced thereon, by killing food-born bacteria and other contaminants.

The slicing of the sanitizing block of this invention will remove built up product coatings or residue on the blade from previously sliced items. These residual amounts of food product from prior sliced products are removed due to the frictional interaction between the sanitizing block and one or preferably both sides of the blade during the cutting and slicing of the block. Preferably, the sanitizing block also cleanses or sanitizes the carriage and the blade of the slicing machine through the chemical interaction of the sanitizing chemical or cleansing solution absorbed in the block. After being sliced off, the sliced portion of the block can be conveniently used to wipe the remaining portions of the tray, carriage, and other parts of the product slicing machine or as an all purpose wipe for the counter tops and other areas of the kitchen, deli, butcher shop or the like.

The sanitizing block of this invention is primarily a supplement to the normal disassembly and cleaning requirements associated with the cleaning of food product slicing machines. In addition, this invention minimizes the carryover of flavors of various items sliced on the product slicing machine and lessens the danger and inconvenience associated with cleaning the product slicing machine.

BRIEF DESCRIPTION OF THE DRAWING

The objectives and features of this invention will become more readily apparent from the detailed description taken in conjunction with the accompanying drawing in which a typical food product slicing machine is shown with a sanitizing block of this invention positioned on a carriage for slicing the block.

DETAILED DESCRIPTION OF THE INVENTION

A sanitizing block 10, according to a preferred embodiment of this invention, is shown in the drawing as used in the cleaning of a food product slicing machine 12, which for purposes of explanation is shown as a gravity type product slicing machine. The slicing machine 12 is used for slicing meats, cheeses, and other items and typically includes a generally L-shaped carriage 14 for supporting the item to be sliced, for example, the sanitizing block 10 as shown in the drawing. The carriage 14 is mounted on the slicing machine 12 at an inclined orientation to support the sanitizing block 10, or other item to be sliced, thereby holding it by gravity against an end wall 16. The slicing machine 12 may include a bracket (not shown) to hold the item to be sliced in place on the carriage 14 and assist in forcing it toward the end wall 16.

The carriage 14 is mounted on the slicing machine 12 to oscillate in a back and forth or linear direction with respect to the stationary end wall 16. The movement of the carriage 14 with respect to the end wall 16 is either manual, in which case a user grasps a handle 18 projecting from an arm 20 on the back side of the carriage 14, or driven by a motor 22 for larger slicing produce.

A circular cutting blade 24 is mounted in the slicing machine 12 for rotation in a plane generally parallel with the end wall 16. The circular cutting blade 24 is driven by a motor 26 which can be adjusted by a knob 28 to achieve the appropriate rotational velocity of the blade. The position of the blade 24 can also be adjusted by a slice thickness control knob 30 to a specific offset with respect to the end wall 16 while remaining generally parallel in relation thereto.

The carriage 14, end wall 16, blade 24, and other components of the slicing machine 12 are typically constructed of stainless steel for durability, cleaning, and maintenance purposes.

As the carriage 14 oscillates in a back and forth direction, the sanitizing block 10, or other item to be sliced, passes over and in contact with both the rotating circular blade 24 and the end wall 16. As the carriage 14 and the sanitizing block 10 advance in the direction of arrow A from the end wall 16 toward the circular blade 24, a portion of the sanitizing block 10 is cut either partially into or wholly therethrough. If the block 10 is cut through, a sliced section is deposited onto a tray 32 positioned below the blade 24 and end wall 16 of the slicing machine 12, just as a slice of salami would be. The thickness of the sliced portion of the sanitizing block 10 is adjusted by the thickness control knob 30. In a preferred mode of operation of this invention, the thickness control knob 30 is set for slicing approximately a one-half to five-eighths inch thick slice from the sanitizing block 10 to thereby further minimize and eliminate the crumbling of the block 10 during the slicing process. If the slice is made too thin, the cut portion may be fragmented or torn, which is undesirable.

In a preferred mode of operation for this invention, the sanitizing block 10 is placed on the carriage 14 and sliced into at a depth of approximately 1 to 3 inches while allowing the blade 24 to rotate within the sliced cut for approximately 15 to 20 seconds. Allowing the blade 24 to turn or rotate within the cut enables the sanitizing block 10 to more fully clean the blade 24. The motor 26 is then turned off and the blade 24 ceases rotation. The blade 24 is then removed from the block 10 and the thickness control knob 30 is adjusted for a slice cut of about ¼ inch thickness. After the motor 26 is then turned on, the block 10 is cut into about five sliced sections of generally equal thickness, thereby further cleaning the blade 24.

The sliced sections of the block 10 which are deposited onto the tray 32 can be used by the operator to wipe the slicing machine 12, thereby cleaning additional portions of the slicing machine 12. Additionally, the sliced sections are useful as a general all purpose wipe for cleaning other surfaces such as counter tops in the deli, kitchen, butcher shop or the like.

The sanitizing block 10, shown positioned on the carriage 14 in the drawing, is preferably rectangular in cross-section, although other configurations are also useful. The sanitizing block 10 is fabricated from a blade wiping and cleaning material in order to effectively remove contaminants and food product residue from the slicing machine and blade. In one embodiment, the sanitizing block 10 is fabricated from poly foam which may be foam rubber. Poly foam is an inert, mildly abrasive cleaning material which will not dull the blade nor crumble when cut thereby. However, the sanitizing block is preferably fabricated from an absorbent material such as a cellulose sponge or a sea sponge. Such absorbent synthetic cellulose sponge materials are widely commercially available, for example from O-CEL-O, a division of General Mills Inc. of Tonawanda, N.Y. and is sold under the name O-CEL-O Sponge F-11, F-12 or F-13 Wet Pack. Other types of suitable cellulose sponge materials are sold under the names Sponge Coarse Pore Wet Pack and Sponge Fine Pore Wet Pack. Preferably, a coarse pore or large cell sponge is used for the sanitizing block 10 of this invention to enhance the cleaning effectiveness. These preferred materials also will not crumble when sliced at thicknesses of about ¼ inch, nor dull the blade 24 when being sliced thereby.

The sanitizing block 10 is preferably absorbent so that it can hold or be impregnated with a cleaning agent or sanitizing solution (not shown) which significantly aids in the cleaning effectiveness of the sanitizing block 10. The cleaning agent can be any of the cleaning solutions on the GRAS list and is preferably a direct food contact no-rinse liquid sanitizer such as Formulation HTA-192, which is commercially available from H & S Chemical Division of Huntington, Ind. and includes n-Alkyl dimethyl benzyl ammonium chloride and/or n-Alkyl dimethyl ethylbenzyl ammonium chloride as active ingredients. Alternatively, a solution of one part common household bleach diluted with one hundred parts of water can be used as the cleaning and sanitizing solution absorbed into the sanitizing block 10. The sanitizing block 10 is preferably packaged pre-moistened with the sanitizing solution. After using the block 10 of this invention, the slicing machine 12 is preferably tuned off and the sanitizing solution is allowed to neutralize the food-born bacteria and other contaminants for approximately one minute before normal slicing is resumed.

The sanitizing block 10 and sanitizing solution, are each fabricated from food grade materials which are suitable for use with food preparation devices and compliant with local health codes and FDA requirements.

From the above disclosure of the general principles of the present invention and the preceding detailed description of a preferred embodiment, those skilled in the art will readily comprehend the various modification to which the present invention is susceptible. Therefore, I desire to be limited only by the scope of the following claims and equivalents thereof.

I claim:

1. A method for cleaning a cutting blade of a food product slicing machine having a carriage on which items are positioned to be sliced by a cutting action of the blade, the method comprising:

providing a cleaning material having a cuttable composition and having a shape of a block adapted to be sliced by the cutting action of the blade having food residue thereon;

positioning said block on the carriage of the slicing machine; and cutting into said block with the blade of the slicing machine, said block being manufactured from said cleaning material which does not crumble and remains in a sectioned configuration after said cutting and does not dull said blade during said cutting, said cutting of said block with said blade thereby cleaning said blade as a result of contact between said blade and said block during said cutting by removing said food residue from said blade without depositing additional food residue on said blade.

2. The method of claim 1 further comprising:

moistening said block with a sanitizing solution to thereby enhance the cleaning of the blade.

3. A method for cleaning a cutting blade of a food product slicing machine having a carriage on which items are positioned to be sliced by a cutting action of the blade, the method comprising:

providing a cleaning material having a cuttable composition and having a shape of a block adapted to be sliced by the cutting action of the blade having food residue thereon;

positioning said block on the carriage of the slicing machine;

cutting into said block with the blade of the slicing machine, said block being manufactured from said cleaning material which does not crumble and remains in a sectioned configuration after said cutting and does not dull said blade during said cutting, said cutting of said block with said blade thereby cleaning said blade as a result of contact between said blade and said block during said cutting by removing said food residue from said blade without depositing additional food residue on said blade; and wiping the slicing machine with a section sliced from said block after said cutting.

4. The method of claim 1 further comprising:

allowing the blade of the slicing machine to rotate within a slice cut into said block to thereby clean the blade.

5. A method for cleaning a cutting blade of a food product slicing machine having a carriage on which items are positioned to be sliced by a cutting action of the blade, the method comprising:

providing a cleaning material having a cuttable composition and having a shape of a block adapted to be sliced by the cutting action of the blade having food residue thereon;

moistening said block with a sanitizing solution to thereby enhance the cleaning of the blade;

positioning said block on the carriage of the slicing machine;

cutting a section from said block with the blade of the slicing machine, said block being manufactured from said cleaning material which does not crumble and remains in a sectioned configuration after said cutting and does not dull said blade during said cutting, said cutting of said block with said blade thereby cleaning said blade as a result of contact between said blade and said block during said cutting; and wiping the slicing machine with said section cut from said block after said cutting.

6. The method of claim 1 further comprising:

repositioning said block on said carriage after said cutting; and performing a subsequent cutting step upon said block to thereby further clean the cutting blade.

7. The method of claim 1 wherein a portion of said block is expended as a result of the cleaning method.

* * * * *